United States Patent [19]

Kaufman

[11] Patent Number: 4,532,995

[45] Date of Patent: Aug. 6, 1985

[54] WELL CASING FLOAT SHOE OR COLLAR

[76] Inventor: Harry J. Kaufman, c/o Oilfield Supply Centre Ltd., Weatherford Oil Tools Ltd., P.O. Box 1518, Dubai, United Arab Emirates

[21] Appl. No.: 523,842

[22] Filed: Aug. 17, 1983

[51] Int. Cl.[3] ..... E21B 34/06

[52] U.S. Cl. ..... 166/327; 166/328

[58] Field of Search ..... 166/242, 325, 326, 327, 166/328; 285/175, DIG. 15

[56] References Cited

U.S. PATENT DOCUMENTS

| | | | |
|---|---|---|---|
| 196,904 | 11/1877 | Ingersoll | 285/175 |
| 1,659,478 | 2/1928 | Black | 166/327 |
| 1,685,307 | 9/1928 | Baker | 166/327 |
| 1,776,613 | 9/1930 | Baker | 166/327 |
| 1,842,897 | 1/1932 | Culp | 285/DIG. 15 |
| 2,075,293 | 3/1937 | Larkin | 166/327 |
| 2,091,428 | 8/1937 | Burt | 166/328 |
| 2,572,299 | 10/1951 | Antolch | 166/325 |
| 2,896,726 | 7/1959 | Bobo | 166/327 |
| 3,481,397 | 12/1969 | Baker | 166/327 |
| 3,525,394 | 8/1970 | Pitts et al. | 166/327 |

*Primary Examiner*—Stephen J. Novosad
*Assistant Examiner*—Bruce M. Kisliuk
*Attorney, Agent, or Firm*—Neal J. Mosely

[57] ABSTRACT

A well casing float shoe which is adapted for a variety of well installations consists of a tubular metal shoe member filled with cementitious material having a longitudinal bore surrounding and securing in place a tubular metal sleeve. The metal sleeve is threaded at the top and bottom ends to receive a variety of sizes and types of check valves. A well casing float collar has the same construction, but the tubular shoe member is replaced with a tubular metal collar with threaded connections both above and below the cementitious filler material.

26 Claims, 6 Drawing Figures

WELL CASING FLOAT SHOE OR COLLAR

BACKGROUND OF THE INVENTION

1. Field of the Invention

This invention relates to new and useful improvements in tools for the drilling of oil and gas wells and more particularly to a float tool such as a float collar or float shoe.

2. Description of the Prior Art

In the History Of Oil Well Drilling, J. E. Brantley, pp. 1273–1279, there is a detailed description given of the origin and development of casing shoes and particularly float shoes and also the development of float collars. The first casing shoes were designed for driving pipe through tight spots and when it was being carried. Float shoes were developed for the purpose of taking the load off the hoist when lowering the drill into a well. The pipe was floated into the well making use of the hollow pipe construction and the drilling mud or other well drilling fluid which surrounds the pipe in the bore hole.

A float shoe is positioned on the bottom of a drill pipe which is being lowered into a well bore and has end portion which is rounded and is filled with cementitious material (cement or concrete). It has a longitudinal passage in which there is positioned a check valve. The check valve closes in an upward direction and opens in a downward direction. As a result, when the pipe is being lowered, the check valve is closed and the pipe is kept free of fluid, thus providing the buoyancy for floating the pipe into position. When the pipe has been lowered into position the cement which is used for cementing the well bore, can be introduced through the pipe and will pass downwardly through the check valve and out around the pipe and upwardly to fill the well bore around the pipe.

Float collars are sometimes used, either alone or together with a float shoe, for providing buoyancy. A float collar may be used to provide buoyancy while still allowing for connection to a drill bit. The float collar differs from a float shoe in that it has threaded connections on both ends for connection on one side to a drill pipe and on the other side to a drill collar or directly to a drill bit sub. These various features of construction are discussed at length in the cited portion of the History Of Oil Well Drilling.

Several patents are illustrative of the patent art on float collars and float shoes.

LeCocq U.S. Pat. No. 1,485,512 discloses a cemented well liner.

Baker U.S. Pat. No. 1,685,307 discloses a metal tubular cementing and floating shoe for use in drilling oil and gas wells. The type of shoe which is shown does not have the typical cemented plug in the end.

Baker U.S. Pat. No. 1,776,613 discloses a well shoe for floating a casing into place. The float shoe which is shown has a downwardly opening check valve which is cemented in place by the cement or concrete plug at the end of the shoe.

Baker U.S. Pat. No. 1,994,846 discloses a float shoe having a plug closure at the end which closes the opening through the shoe while the casing is being floated into the place. The plug may thereafter be forced out to permit the cementing of the well.

Harris U.S. Pat. No. 3,322,499 discloses a another type of float shoe having a check valve cemented in place.

SUMMARY OF THE INVENTION

One object of this invention is to provide a new and improved casing float shoe or casing float collar which is inexpensive to manufacture and easily assembled for use.

Another object of this invention is to provide a new and improved casing float shoe or casing float collar which has a supporting housing and cement plug of substantially uniform size and arranged to receive and support a variety of sizes and types of check valve assemblies.

Another object of this invention is to provide a new and improved casing float shoe or casing float collar which has a supporting housing and cement plug of substantially uniform size and having an internal tubular supporting member threaded at each end to receive and support a variety of sizes and types of check valve assemblies.

Other objects of this invention will become apparent from time to time throughout the specification and claims as hereinafter related.

These and other objects of the invention are achieved by a well casing float shoe which is adapted for a variety of well installations. The float shoe consists of a tubular metal shoe member filled with cementitious material having a longitudinal bore surrounding and securing in place a tubular metal sleeve. The metal sleeve is threaded at the top and bottom ends to receive a variety of sizes and types of check valves. A well casing float collar has the same construction, but the tubular shoe member is replaced with a tubular metal collar with threaded connections both above and below the cementitious filler material.

DESCRIPTION OF A PREFERRED EMBODIMENT

Figure 1:
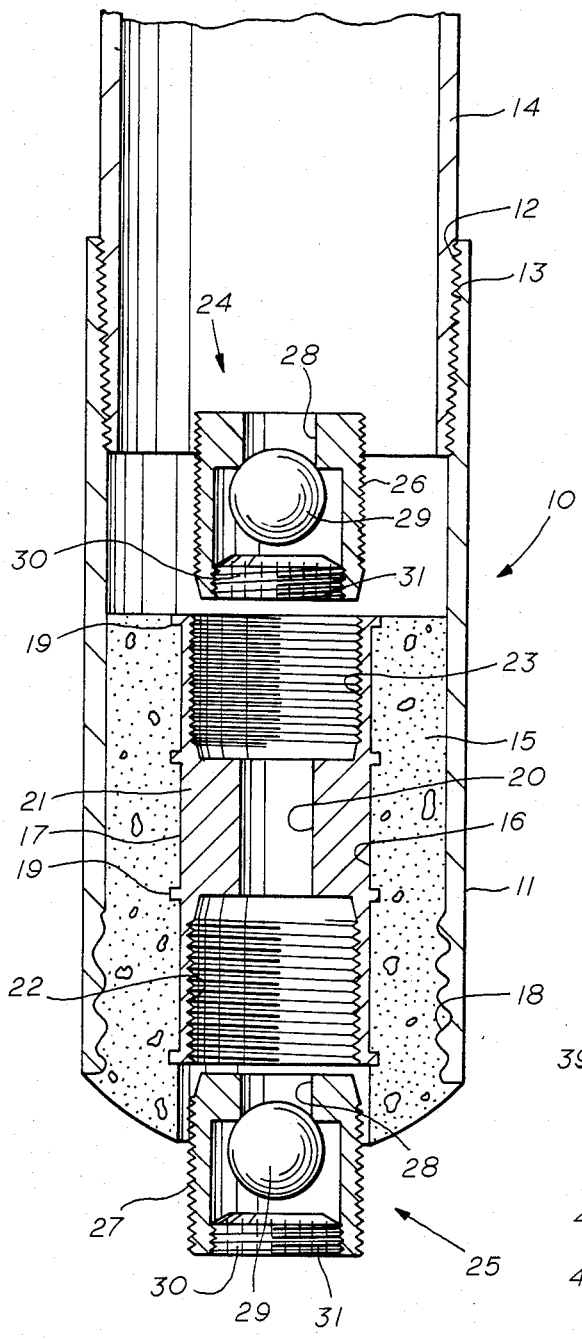
FIG. 1 is a view in longitudinal central section of a float shoe representing a preferred embodiment of the invention and showing check valves in exploded relation to the internal supporting sleeve in the shoe.

Referring to the drawings by numerals of reference, and more particularly to FIG. 1, there is shown a casing float shoe 10 which comprises a hollow tubular housing 11 which is internally threaded at 12 for connection to the threaded lower end thirteen of a section of casing 14. The lower end of housing 11 is filled with cementitious material 15 which may be cement or any suitable concrete composition. The cementitious plug 15 has a longitudinal passage 16 therein in which there is a positioned a tubular supporting sleeve 17.

The lower end of housing 11 has a plurality of internal grooves 18 which assist in securing the cementitious plug 15 in place. The tubular supporting sleeve 17 is positioned in a central location, as shown, and oriented in a longitudinal direction direction in housing 11 and is secured in place by having the cementitious material cast around it and allowed to set into the desired shape. Tubular supporting sleeve 17 has a plurality of external peripherally extending flanges 19 which assist in holding it in place in the cementitious plug.

Tubular supporting sleeve 17 has a central portion with a small diameter passage 20 defined by a thick wall portion 21. The passage through tubular supporting sleeve 17 is enlarged at opposite ends and internally threaded as indicated at 22 and 23. The apparatus is provided with a pair of check valve assemblies 24 and 25.

These check valve assemblies are substantially the same in construction but may differ in size of the valve opening. Also, the external threads 26 on valve assembly 24 match the threads 23 at the upper end of tubular supporting housing 17. The threads 27 on valve assembly 25 match the threads 22 on the lower end of tubular supporting housing 17.

These threads are sized differently so that the valve assemblies will not be interchanged and used in the wrong position. The valve assemblies 25 and 26 are each provided with an opening 28 providing a valve seat which is closed by a ball valve 29. The valve assembly is of an enclosed cage shape and has a downwardly facing end wall 30 with apertures 31 for passage of drilling fluid or cement therethrough.

ANOTHER EMBODIMENT OF THE CHECK VALVE

Figure 2:
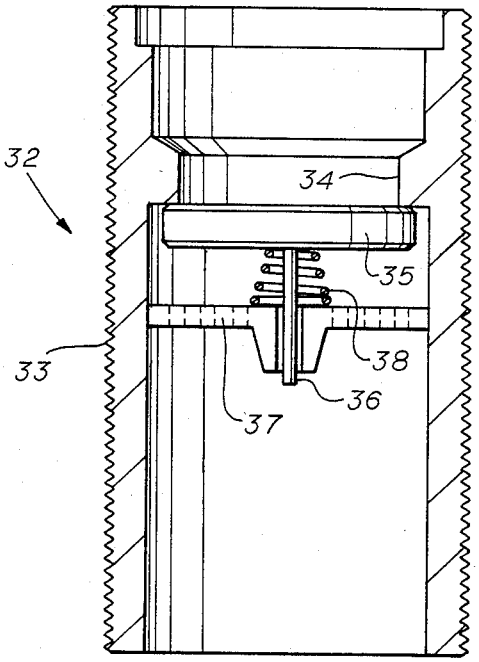
FIG. 2 is a view in longitudinal central section of another embodiment of the check valve insert.

In FIG. 2, there is shown a different embodiment of check valve for use in the casing float shoe 10 of FIG. 1. In this embodiment, valve assembly 32 is tubular in shape and externally theaded as indicated at 33 along its entire length. The upper and lower check valve assemblies have slightly different external threads to insure that they are located properly during the assembly of the apparatus. Check valve assembly 32 has an internal passage 34 providing a valve opening which is closed by a valve member 35. Valve member 35 has a guide stem 36 which extends through a supporting spider 37. A spring 38 is positioned between spider 37 and valve 35 to bias the valve member toward an upwardly closed position.

ANOTHER EMBODIMENT OF THE CHECK VALVE

Figure 3:
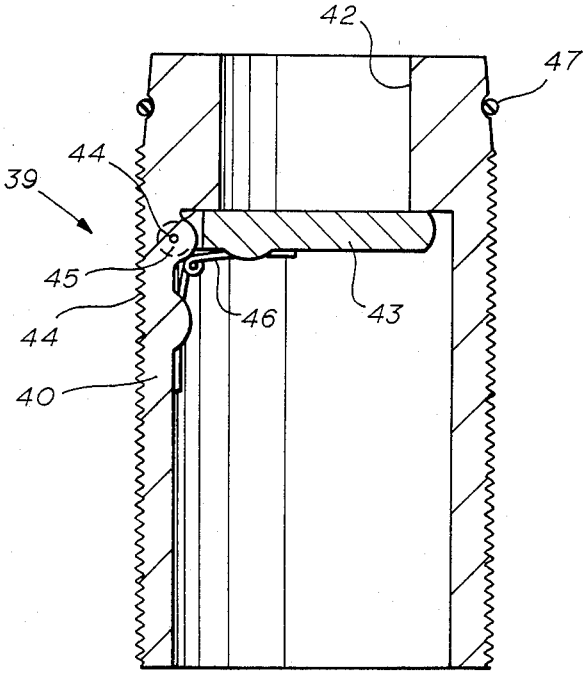
FIG. 3 is a view in longitudinal central section of still another embodiment check valve insert.

In FIG. 3 there is shown a further embodiment of check valve 39 for use in the float shoe 10. Check valve assembly 39 consists of tubular housing 40 which is externally threaded at 41. Tubular valve housing 40 has a passage 42 providing a valve seat which is closed by valve member 43. Valve member 43 is pivoted at 44 on an internal boss 45 in housing 40. Valve member 43 is bias by spring 46 toward a valve closed position. A sealing O-ring 47 surrounds the upper end of the valve assembly housing 40 to provide an external seal when the valve assembly is threaded into the supporting housing. The O-ring 47 can be used with any of the several embodiments of the check valve assembly.

ANOTHER EMBODIMENT OF THE CHECK VALVE

Figure 4:
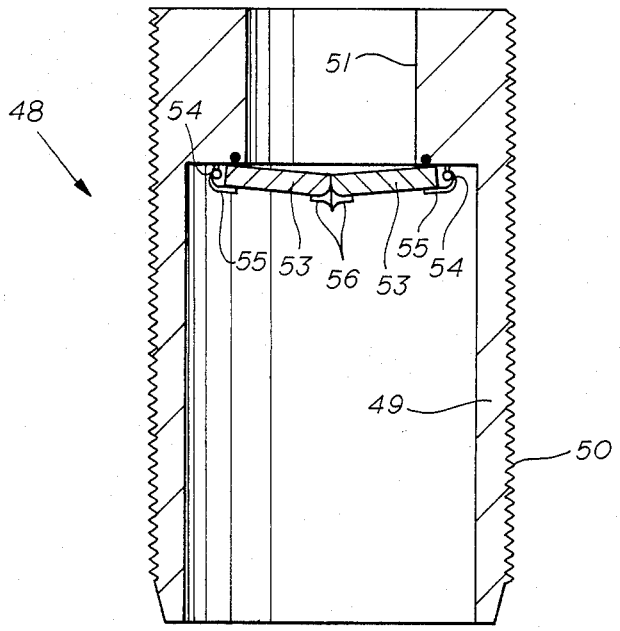
FIG. 4 is a view longitudinal central section of a check valve insert having a three-part valve.
Figure 5:
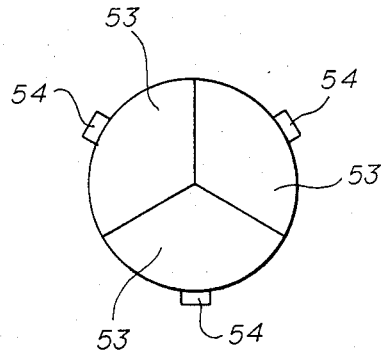
FIG. 5 is a bottom view of the three part valve shown in FIG. 4.

In FIGS. 4 and 5, there is shown still another embodiment of check valve 48. Check valve 48 comprises a tubular housing 49 which is externally threaded as indicated at 50 for support in the supporting sleeve 17 of the float shoe 10. In this check valve assembly, there is an internal passage 51 which provides a valve seat assembly against which the check valve member seal. The valve member in this embodiment, comprises a plurality of separate valve segments 53. There are three segments 53 which are hinged at 54, with a surrounding rubber seal 55. Each of the valve 53 has a lip seal 56. The valve segments 53 touch on metal to metal contact when closed and the lip seals 56 are pressed together by pressure on the downside to provide a tighter seal.

THE INVENTION AS APPLIED TO A FLOAT COLLAR

Figure 6:
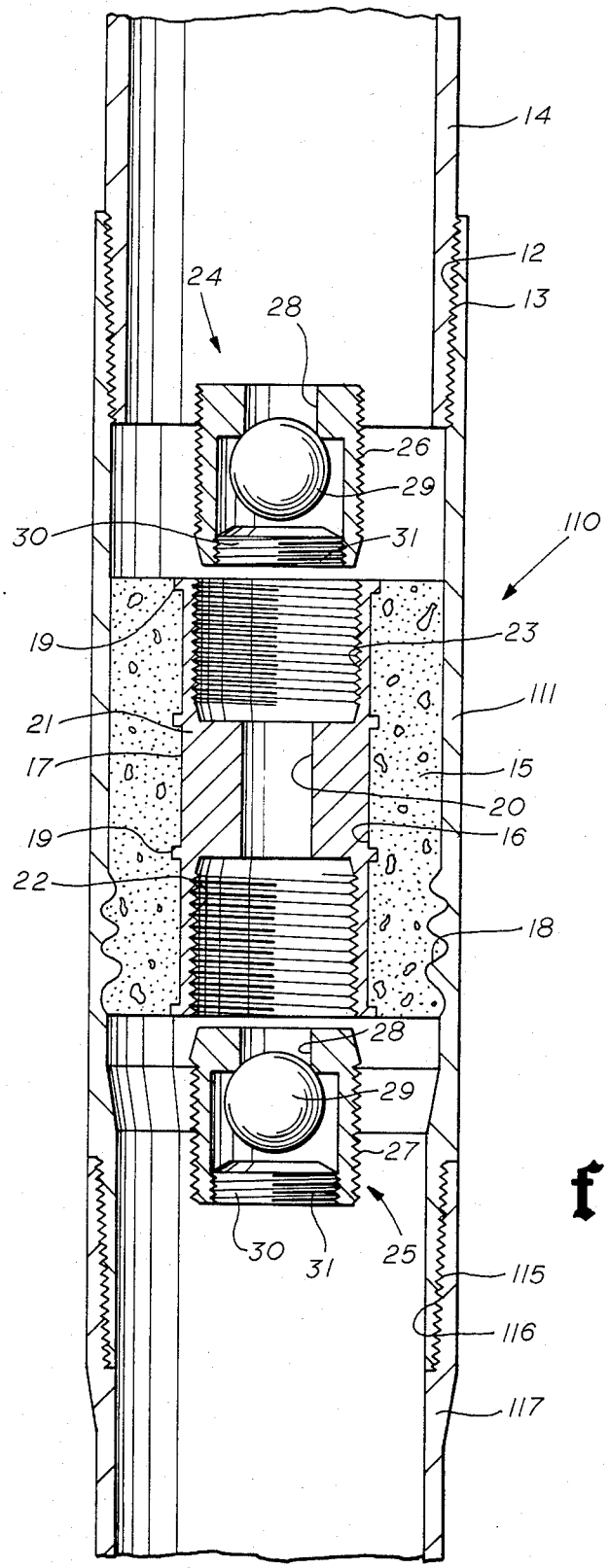
FIG. 6 is a view in longitudinal central section of a float collar made in accordance with this invention.

In FIG. 6, the invention is illustrated as applied to a float collar. In this embodiment, float collar 110 comprises a tubular housing 111 which is internally threaded as indicated at 12 at the upper end portion for connection to the threaded lower end 13 of a drill pipe 14. The extreme lower end of tubular housing 111 is externally threaded as indicated at 115 to provide a pin connection to the box thread 116 of a drill collar 117. The internal construction of the float collar 110 is otherwise identical to the embodiment shown in FIG. 1 and like components are given like reference numerals and perform like functions. The other embodiments of the check valves as shown in FIGS. 2–5 can be used in the float collar assembly as well as in the float shoe assembly.

OPERATION

The operation of the several embodiments of the float shoe and float collar should be apparent from the foregoing description of their construction and assembly. However, to understand the advantages of the invention fully, one should consider briefly the problems encountered by the prior art as embodied in the float shoes and float collars which are now available commercially.

The present, commercially available float shoes are generally constructed substantially as shown in Baker U.S. Pat. No. 1,776,613. Casing float shoes are commercially made as pre-assembled structures of the type shown in the Baker Patent in which the check valves are cemented in place in the float shoe assembly at the time of manufacture. This construction has made it necessary to construct casing float shoes to fit specific casing sizes and to fit specific requirements of size, shape and configuration of the check valves used in the float shoe assembly.

As a result, a manufacturer usually has to stock a large variety of sizes of casing float shoes. The casing float shoes are customarily made at a point of manufacture usually in the United States, and shipped to regional warehouses at various locations around the world. The weight of a casing float shoe, inclusive of the housing and cementitious plug, is considerable and the cost of transportation is high. Because of the large number of sizes and configurations of casing float shoes which are customarily used, it has been virtually impossible to stock an adequate inventory at regional warehouses. As a result, if a need arises for a float shoe of a size which is temporarily out of stock, there may be a long delay in obtaining the float shoe or the float shoe may be shipped in by air at considerable expense.

The casing float shoe described above, as illustrated in FIG. 1, consists of a float shoe housing with a cementitious plug which holds in place supporting tubular member threaded to receive the upper and lower check valves. The casing shoe assembly, with the check valves removed, may be warehoused in a reasonable inventory at any particular location. The warehousing facility can stock a suitable number of appropriate sizes and configurations of the check valves which can be installed at the warehouse facility to produce any desired construction.

If a particular check valve happens to be out of stock, it is relatively inexpensive to ship replacements in by air. This avoids the necessity of shipping the heavy weight of the float shoe housing and the cementitious plug.

The float collar as shown in FIG. 6 functions in exactly the same manner as the float shoe except that it is positioned between the casibg shoe and one joint of casing. The float collars can likewise be warehoused with the check valve removed and can be provided with check valves of any desired shape for configuration for any particular installation.

The casing float shoe and float collar which are provided by this invention result in a substantial reduction in cost of manufacture and especially in the cost of shipment to field warehouses.

While this invention has been described fully and completely with special emphasis upon several preferred embodiments, it should be understood that within the scope of the appended claims the invention may be practiced otherwise than as specifically described herein.

I claim:

1. A casing float tool for wells comprising a tubular metal housing having internal threads at one end for connection in a casing string, a mass of cementitious material supported on and extending inwardly from the inner wall surface of said housing and having a longitudinal passageway therethrough, a tubular supporting member secured in and filling said cementitious passageway and having a passageway therethrough with externally unobstructed internally threaded opposite ends, and check valves removably secured one in each of said unobstructed internally threaded ends of said tubular supporting member, said check valves each comprising a tubular housing with external threads sized for securing said valves threadedly in said supporting member an removable therefrom without interference from said cementitious material or other structure in said housing, and a check valve member closing in an upward direction and opening in a downward direction in each of said tubular valve housings.

2. A casing float tool according to claim 1 in which said tubular metal housing is a float shoe housing internally threaded at one end and having said cementitious material in the other end.

3. A casing float tool according to claim 1 in which said tubular metal housing is a float collar housing internally threaded at both ends and having said cementitious material in the middle portion thereof.

4. A casing float tool according to claim 1 in which said tubular supporting member is a tubular metal member having peripherally extending ribs spaced longitudinally thereof embedded in said cementitious material to secure the same in place, and having an intermediate portion of substantially smaller diameter than said threaded end portions defining a restricted flow passage therein.

5. A casing float tool according to claim 1 in which the threads are of different configuration at opposite ends of said tubular supporting member, and said check valve housings have external thread configurations determining the relative placement of said valves in said tubular supporting member.

6. A casing float tool according to claim 1 in which said check valves each comprises a tubular housing forming an enclosed cage with opposite end openings, with external threads sized for removably securing said valves in said supporting member, and having an internal opening defining a valve seat, and a ball check valve member, positioned in said cage, closing in an upward direction against said valve seat and opening by gravity in a downward direction.

7. A casing float tool according to claim 1 in which said check valves each comprises a tubular housing with external threads sized for removably securing said valves in said supporting member, and having an internal opening defining a valve seat, a supporting spider, and a check valve member supported therein, spring biased to close in an upward direction against said valve seat and opening by fluid flow through said tool in a downward direction.

8. A casing float tool according to claim 1 in which said check valves each comprises a tubular housing with external threads sized for removably securing said valves in said supporting member, and having an internal opening defining a valve seat, and a spring biased check valve member pivotally supported therein, closing in an upward direction against said valve seat and opening by fluid flow through said tool in a downward direction.

9. A casing float tool according to claim 1 in which said check valves each comprises a tubular housing with external threads sized for removably securing said valves in said supporting member, and having an internal opening defining a valve seat, and spring biased check valve means pivotally supported therein, closing in an upward direction against said valve seat and opening by fluid flow through said tool in a downward direction, said check valve means comprising a three-part check valve, each part being pivotally supported around said valve seat and closing cooperatively against said valve seat.

10. A casing float tool according to claim 1 in which said tubular metal housing is a float shoe housing internally threaded at one end and having said cementitious material in the other end, said tubular supporting member is a tubular metal member having peripherally extending ribs spaced longitudinally thereof embedded in said cementitious material to secure the same in place, and having an intermediate portion of substantially smaller diameter than said threaded end portions defining a restricted flow passage therein, said check valve housings have external thread configurations determining the relative placement of said valves in said tubular supporting member, said check valves each comprises a tubular housing forming an enclosed cage with opposite end openings, with external threads sized for removably securing said valves in said supporting member, and having an internal opening defining a valve seat, and a ball check valve member, positioned in said cage, closing in an upward direction against said valve seat and opening by gravity in a downward direction.

11. A casing float tool according to claim 1 in which said tubular metal housing is a float shoe housing internally threaded at one end and having said cementitious material in the other end, said tubular supporting member is a tubular metal member having peripherally extending ribs spaced longitudinally thereof embedded in said cementitious material to secure the same in place, and having an intermediate portion of substantially smaller diameter than said threaded end portions defining a restricted flow passage therein, said check valve housings have external thread configurations determining the relative placement of said valves in said tubular supporting member, said check valves each comprises a tubular housing with external threads sized for removably securing said valves in said supporting member, and having an internal opening defining a valve seat, a supporting spider, and a check valve member supported therein, spring biased to close in an upward direction against said valve seat and opening by fluid flow through said tool in a downward direction.

12. A casing float tool according to claim 1 in which said tubular metal housing is a float shoe housing internally threaded at one end and having said cementitious material in the other end, said tubular supporting member is a tubular metal member having peripherally extending ribs spaced longitudinally thereof embedded in said cementitious material to secure the same in place, and having an intermediate portion of substantially smaller diameter than said threaded end portions defining a restricted flow passage therein, said check valve housings have external thread configurations determining the relative placement of said valves in said tubular supporting member, said check valves each comprises a tubular housing with external threads sized for removably securing said valves in said supporting member, and having an internal opening defining a valve seat, and a spring biased check valve member pivotally supported therein, closing in an upward direction against said valve seat and opening by fluid flow through said tool in a downward direction.

13. A casing float tool according to claim 1 in which said tubular metal housing is a float shoe housing internally threaded at one end and having said cementitious material in the other end, said tubular supporting member is a tubular metal member having peripherally extending ribs spaced longitudinally thereof embedded in said cementitious material to secure the same in place, and having an intermediate portion of substantially smaller diameter than said threaded end portions defining a restricted flow passage therein, said check valve housings have external thread configurations determining the relative placement of said valves in said tubular supporting member, said check valves each comprises a tubular housing with external threads sized for removably securing said valves in said supporting member, and having an internal opening defining a valve seat, and spring biased check valve means pivotally supported therein, closing in an upward direction against said valve seat and opening by fluid flow through said tool in a downward direction, said check valve means comprising a three-part check valve, each part being pivotally supported around said valve seat and closing cooperatively against said valve seat.

14. A casing float tool according to claim 1 in which said tubular metal housing is a float collar housing internally threaded at both ends and having said cementitious material in an intermediate portion thereof, said tubular supporting member is a tubular metal member having peripherally extending ribs spaced longitudinally thereof embedded in said cementitious material to secure the same in place, and having an intermediate portion of substantially smaller diameter than said threaded end portions defining a restricted flow passage therein, said check valve housings have external thread configurations determining the relative placement of said valves in said tubular supporting member, said check valves each comprises a tubular housing forming an enclosed cage with opposite end openings, with external threads sized for removably securing said valves in said supporting member, and having an internal opening defining a valve seat, and a ball check valve member, positioned in said cage, closing in an upward direction against said valve seat and opening by gravity in a downward direction.

15. A casing float tool according to claim 1 in which said tubular metal housing is a float collar housing internally threaded at both ends and having said cementitious material in an intermediate portion thereof, said tubular supporting member is a tubular metal member having peripherally extending ribs spaced longitudinally thereof embedded in said cementitious material to secure the same in place, and having an intermediate portion of substantially smaller diameter than said threaded end portions defining a restricted flow passage therein, said check valve housings have external thread configurations determining the relative placement of said valves in said tubular supporting member, said check valves each comprises a tubular housing with external threads sized for removably securing said valves in said supporting member, and having an internal opening defining a valve seat, a supporting spider, and a check valve member supported therein, spring biased to close in an upward direction against said valve seat and opening by fluid flow through said tool in a downward direction.

16. A casing float tool according to claim 1 in which said tubular metal housing is a float collar housing internally threaded at both ends and having said cementitious material in an intermediate portion thereof, said tubular supporting member is a tubular metal member having peripherally extending ribs spaced longitudinally thereof embedded in said cementitious material to secure the same in place, and having an intermediate portion of substantially smaller diameter than said threaded end portions defining a restricted flow passage therein, said check valve housings have external thread configurations determining the relative placement of said valves in said tubular supporting member, said check valves each comprises a tubular housing with external threads sized for removably securing said valves in said supporting member, and having an internal opening defining a valve seat, and a spring biased check valve member pivotally supported therein, closing in an upward direction against said valve seat and opening by fluid flow through said tool in a downward direction.

17. A casing float tool according to claim 1 in which said tubular metal housing is a float collar housing internally threaded at both ends and having said cementitious material in an intermediate portion thereof, said tubular supporting member is a tubular metal member having peripherally extending ribs spaced longitudinally thereof embedded in said cementitious material to secure the same in place, and having an intermediate portion of substantially smaller diameter than said threaded end portions defining a restricted flow passage therein, said check valve housings have external thread configurations determining the relative placement of said valves in said tubular supporting member, said check valves each comprises a tubular housing with external threads sized for removably securing said valves in said supporting member, and having an internal opening defining a valve seat, and spring biased check valve means pivotally supported therein, closing in an upward direction against said valve seat and opening by fluid flow through said tool in a downward direction, said check valve means comprising a three-part check valve, each part being pivotally supported around said valve seat and closing cooperatively against said valve seat.

18. A kit of materials for assembly into a casing float tool for wells comprising a tubular metal housing having internal threads at one end for connection in a casing string, a mass of cementitious material supported on and extending inwardly from the inner wall surface of said housing and having a longitudinal passageway therethrough, a tubular supporting member secured in and filling said cementitious passageway and having a passageway therethrough with externally unobstructed internally threaded opposite ends, and a plurality of check valves adapted to be removably secured in either of said unobstructed internally threaded ends of said tubular supporting member, said check valves each comprising a tubular housing with external threads sized for securing said valves threadedly in said supporting member and removable therefrom without interference from said cementitious material or other structure in said housing, and a check valve member closing in an upward direction and opening in a downward direction in each of said tubular valve housings.

19. A kit of materials according to claim 18 in which said tubular metal housing is a float shoe housing internally threaded at one end and having said cementitious material in the other end.

20. A kit of materials according to claim 18 in which said tubular metal housing is a float collar housing internally threaded at both ends and having said cementitious material in the middle portion thereof.

21. A kit of materials according to claim 18 in which said tubular supporting member is a tubular metal member having peripherally extending ribs spaced longitudinally thereof embedded in said cementitious material to secure the same in place, and having an intermediate portion of substantially smaller diameter than said threaded end portions defining a restricted flow passage therein.

22. A kit of materials according to claim 18 in which the threads are of different configuration at opposite ends of said tubular supporting member, and said check valve housings have external thread configurations determining the relative placement of said valves in said tubular supporting member.

23. A kit of materials according to claim 18 in which said check valves each comprises a tubular housing forming an enclosed cage with opposite end openings, with external threads sized for removably securing said valves in said supporting member, and having an internal opening defining a valve seat, and a ball check valve member, positioned in said cage, closing in an upward direction against said valve seat and opening by gravity in a downward direction.

24. A kit of materials according to claim 18 in which said check valves each comprises a tubular housing with external threads sized for removably securing said valves in said supporting member, and having an internal opening defining a valve seat, a supporting spider, and a check valve member supported therein, spring biased to close in an upward direction against said valve seat and opening by fluid flow through said tool in a downward direction.

25. A kit of materials according to claim 18 in which said check valves each comprises a tubular housing with external threads sized for removably securing said valves in said supporting member, and having an internal opening defining a valve seat, and a spring biased check valve member pivotally supported therein, closing in an upward direction against said valve seat and opening by fluid flow through said tool in a downward direction.

26. A kit of materials according to claim 18 in which said check valves each comprises a tubular housing with external threads sized for removably securing said valves in said supporting member, and having an internal opening defining a valve seat, and spring biased check valve means pivotally supported therein, closing in an upward direction against said valve seat and opening by fluid flow through said tool in a downward direction, said check valve means comprising a three-part check valve, each part being pivotally supported around said valve seat and closing cooperatively against said valve seat.

* * * * *